US010362639B2

(12) United States Patent
Davenport et al.

(10) Patent No.: US 10,362,639 B2
(45) Date of Patent: Jul. 23, 2019

(54) COOKTOP

(71) Applicant: BREVILLE PTY LIMITED, Alexandria (AU)

(72) Inventors: David Davenport, Alexandria (AU); Ellaluna Taylor, Alexandria (AU); Vyvyan Rose, Alexandria (AU); Catherine Mary Ruspino, Alexandria (AU); Richard Lehonde Hoare, Alexandria (AU); Brendan Foxlee, Alexandria (AU)

(73) Assignee: BREVILLE PTY LIMITED, Alexandria (AU)

( * ) Notice: Subject to any disclaimer, the term of this patent is extended or adjusted under 35 U.S.C. 154(b) by 116 days.

(21) Appl. No.: 15/525,126

(22) PCT Filed: Nov. 6, 2015

(86) PCT No.: PCT/AU2015/000671
§ 371 (c)(1),
(2) Date: May 8, 2017

(87) PCT Pub. No.: WO2016/070233
PCT Pub. Date: May 12, 2016

(65) Prior Publication Data

US 2018/0279422 A1 Sep. 27, 2018

(30) Foreign Application Priority Data

Nov. 7, 2014 (AU) ..... 2014904483
Jul. 8, 2015 (AU) ..... 2015902689

(51) Int. Cl.
*H05B 6/06* (2006.01)
*H05B 6/12* (2006.01)

(52) U.S. Cl.
CPC ..... *H05B 6/062* (2013.01); *H05B 6/1209* (2013.01); *H05B 2213/07* (2013.01)

(58) Field of Classification Search
CPC ... H05B 2213/07; H05B 6/062; H05B 6/1209
(Continued)

(56) References Cited

U.S. PATENT DOCUMENTS 3,742,175 A * 6/1973 Harnden, Jr. ..... A47J 27/62 219/504
3,786,220 A * 1/1974 Harnden, Jr. ..... F24C 15/105 219/445.1
(Continued)

FOREIGN PATENT DOCUMENTS

EP 1037508 A1 9/2000
EP 1688721 A1 8/2006
(Continued)

OTHER PUBLICATIONS

Supplementary European Search Report dated May 23, 2018 for Application No. 15856305.6.
(Continued)

*Primary Examiner* — William M McCalister
(74) *Attorney, Agent, or Firm* — Moser Taboada

(57) ABSTRACT

The present disclosure describes an induction cooker (100) having an induction element (104) for heating a cooking vessel (106) containing a food substance. The induction cooker (100) also has a temperature sensor (120) for measuring a temperature of the cooking vessel (106) or food substance. A memory is also includes having stored therein a cooking sequence. The cooking sequence includes sequential stages, each stage being defined by a set temperature to be reached by the cooking vessel (106) or food substance, a set maximum power applied to the induction element (104) during heating and a time associated with the stage. A
(Continued)

controller is included for retrieving the cooking sequence and controlling the induction element (104) based upon the cooking sequence and the temperature measured.

10 Claims, 8 Drawing Sheets

(58) Field of Classification Search
USPC ..... 219/620, 621, 622, 624, 626, 627, 635, 219/650, 665, 667
See application file for complete search history.

(56) References Cited

U.S. PATENT DOCUMENTS 5,283,412 A * 2/1994 Gouardo ..... H05B 6/062 219/448.13
5,448,038 A * 9/1995 Kim ..... H05B 1/0266 219/627
2004/0149736 A1 8/2004 Clothier
2009/0139981 A1 6/2009 Moon
2012/0152932 A1 6/2012 Moon et al.
2012/0168425 A1* 7/2012 Aldana Arjol ..... H05B 1/0269 219/482
2013/0112683 A1* 5/2013 Hegedis ..... A47J 27/62 219/660
2013/0119049 A1* 5/2013 Graber ..... H05B 6/062 219/621
2014/0157998 A1* 6/2014 Roever ..... H05B 6/1245 99/483
2015/0272385 A1* 10/2015 Wang ..... H05B 6/06 219/627
2015/0373787 A1* 12/2015 Visher ..... H05B 6/062 219/622

FOREIGN PATENT DOCUMENTS

EP 2202462 A1 6/2010
EP 2247158 A1 11/2010
GB 2508198 A 5/2014
JP 2005340119 A 12/2005
WO WO-2012006674 A1 1/2012

OTHER PUBLICATIONS

International Search Report dated Feb. 8, 2016 for PCT Application No. PCT/AU2015/000671.

* cited by examiner

COOKTOP

TECHNICAL FIELD

The present invention relates generally to cooktops and, in particular, to induction cooktops and the control thereof.

BACKGROUND

In a cooktop, such as gas, electric and induction cooktop, a control mechanism is provided for controlling the amount of heat transferred to a cooking vessel placed thereon. That heat is then transferred from the cooking vessel to any food substance placed therein. With the amount of heat being maintained at a constant, many factors influence the temperature change occurring in the food substance, and the temperature reached over time.

A need exits for an alternative cooktop providing a user with improved control over the amount of heat transferred to the food substance, and the temperature of the food substance generally.

SUMMARY

According to a first aspect of the present disclosure, there is provided an induction cooker comprising:

an induction element for heating a cooking vessel containing a food substance;

a temperature sensor for measuring a temperature of the cooking vessel or food substance;

a memory having stored therein a cooking sequence, the cooking sequence comprising a plurality of sequential stages, each stage being defined by a set temperature to be reached by the cooking vessel or food substance, a set maximum power applied to the induction element during heating and a time associated with the stage; and a controller for retrieving the cooking sequence and controlling the induction element based upon the cooking sequence and the temperature measured.

According to a second aspect of the present disclosure, there is provided an induction cooker comprising:

an induction element for heating a cooking vessel containing a food substance;

a first temperature sensor for measuring a temperature of the food substance;

a second temperature sensor for measuring a temperature of the cooking vessel;

a controller for:

determining whether the temperature from the first temperature sensor meets predefined criteria;

upon determining that the predefined criteria are met, controlling the induction element using the temperature from the first temperature sensor to achieve a set temperature; and upon determining that the predefined criteria are not met, controlling the induction element using the temperature from the second temperature sensor to achieve the set temperature.

Other aspects of the invention are also disclosed.

BRIEF DESCRIPTION OF THE DRAWINGS

One or more embodiments of the present invention will now be described with reference to the drawings, in which.

DESCRIPTION OF EMBODIMENTS

Described herein is an induction cooktop which provides a user with improved control over the amount of heat transferred to a food substance being heated on the cooktop, and the temperature of the food substance reached.

Figure 1:
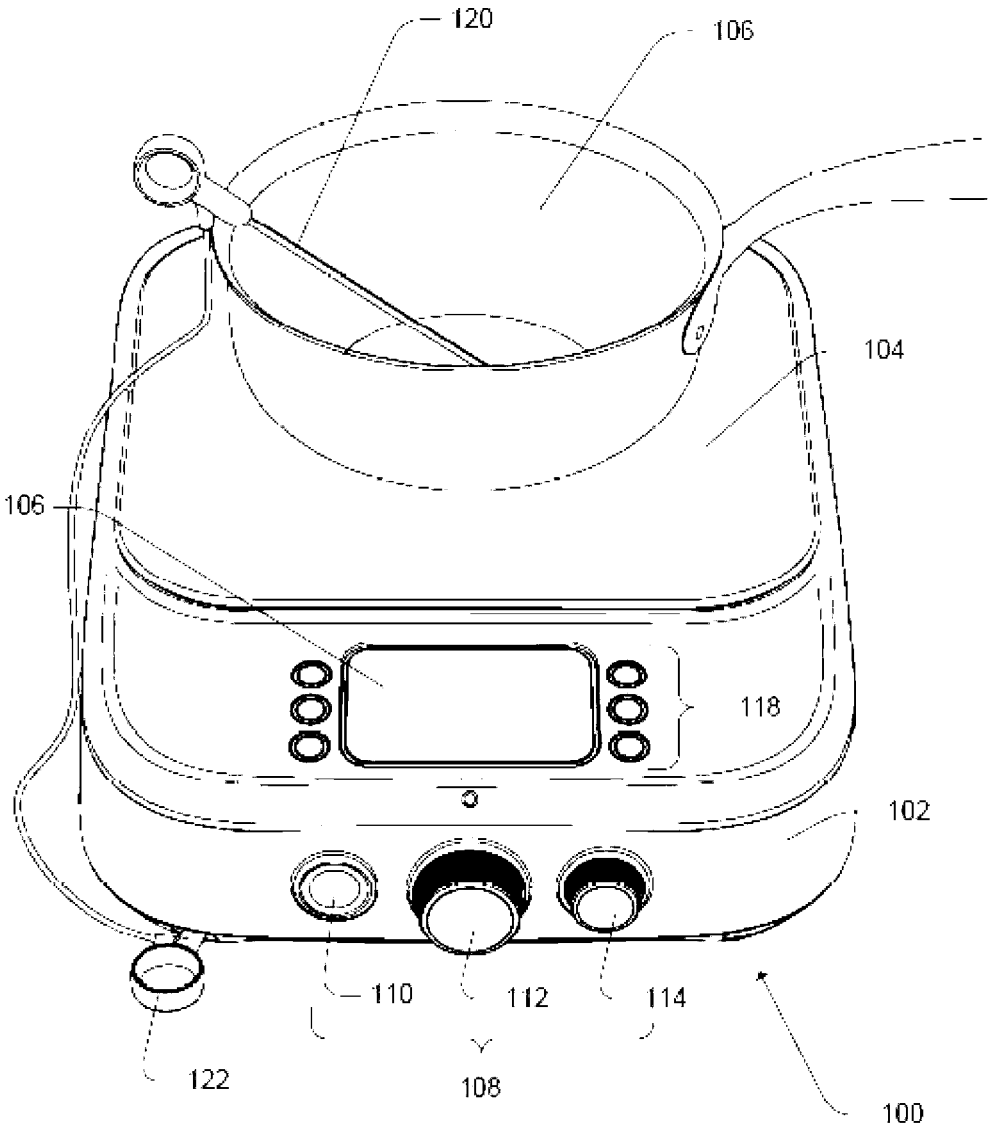
FIG. 1 is a perspective view of a portable induction cooker.

FIG. 1 is a perspective view of a portable induction cooker 100. The induction cooker 100 has a base 102 supporting a cooktop surface 104 on which a cooking vessel rests. The cooking vessel shown is a saucepan 106. The cooker 100 has a user interface 108 for controlling the operation thereof, the user interface 108 being described in more detail below.

The cooker 100 also includes a number of sensors that contribute to the operation thereof. A surface temperature sensor situated approximately in the middle of the cooktop surface 104 (hidden beneath the saucepan 106 in FIG. 1) is used to detect the temperature of the base of the cooking vessel used for cooking, such as the saucepan 106 shown. In some embodiments two or more surface temperature sensors may be used, distributed over the cooktop surface 104. A temperature probe 120, connected to the cooker 100 via a connector 122 plugged into a receiving port in the base 102, provides an additional measured temperature of a food substance in the cooking vessel being heated.

Figure 2:
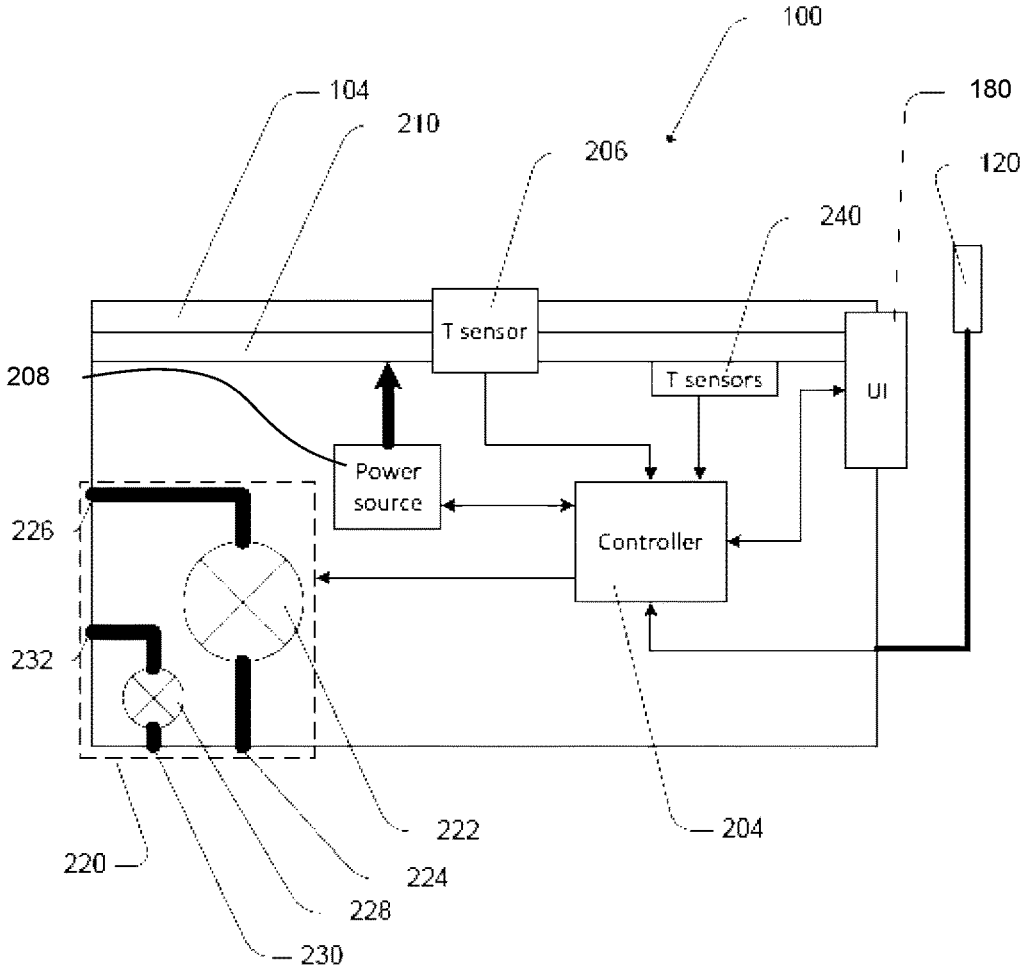
FIG. 2 is a schematic representation of the induction cooker of FIG. 1.

FIG. 2 is a schematic representation of the induction cooker 100 of FIG. 1. The cooker 100 has a controller 204 that receives user inputs from the user interface (UI) 108, as well as from a number of sensors in the cooker 100. The controller 204 is implemented on a processor (such as a microprocessor, microcontroller, DSP, FPGA or similar), the processor being connected to memory, and having I/O interfacing. Functionally, the controller 204 includes various control subsystems for controlling various features of the cooker 100.

A fan assembly 220 is also included, with the fan assembly 220 including a coil fan 222 with coil ingress air path 224 and a coil egress air path 226, and an electronics fan 228 with an electronics ingress air path 230 and an electronics egress air path 232. The coil fan 222 provides cooling airflow to the induction coil 210, whereas the electronics fan 228 provides cooling airflow to the electronics of the cooker 100 (e.g. a heat sink temperature associated with one or more power switches). The operation of the fan assembly 220 is controlled by the controller 204.

The sensors providing input to the controller 204 include one or more temperature sensors. The temperature sensors in this embodiment include a surface temperature sensor 206 that extends through the cooktop surface 104 and is adapted to abut and measure the temperature of a bottom surface of a cooking vessel resting on the cooker 100. The temperature sensors also include an external probe temperature sensor 120 as shown in FIG. 1. One or more temperature sensors 240 provide additional temperature measurements, for example sensors associated with the electronics and temperature measurements associated with the heating system (e.g. the induction coil 210 or the cooktop surface 104 itself).

The cooker 100 also includes a power source 208 providing electrical power to an induction coil 210 situated below the cooking surface 104. The power source 208 is also controlled by the controller 204.

The controller 204 also receives one or more inputs from the power source 208 of the cooker 100 indicative of the operation of the power source 208, for example a current indication, a voltage indication, and/or a power indication, one or more of these indicative of the operation and state of the cooker 100. For example, if high power is provided to the heating system, in this case an induction coil 210, for the provision of rapid heating and/or a high steady state temperature, this may result in a high current indication being provided to the controller 204. The controller 204 uses the current indication as a predictor for the temperature state of cooktop components such as the cooker's internal electronics. If high current is drawn, then it is an indication that the internal electronics may heat up, and therefore this measurement may be used in the control of the cooker's fan assembly 220.

Referring again to FIG. 1, the user interface 108 includes an on/off power button 110 and two dials 112, 114 on the front surface of the base 102. The user interface 108 further includes a display 116 flanked by a number of push buttons 118 on the top surface of the base 102 in front of the cooktop surface 104. As is described in detail below, the various components of the user interface 108 are used a) to receive simple user inputs for operating parameters, such as a set temperature, a cooking time and a maximum power setting, b) to set up or select compound user inputs, such as cooking profiles and sequences, and c) to display information to the user, such as cooking status or menu functions.

The maximum power setting dictates the maximum power used in operating the heating system, i.e. the heating intensity, which in turn controls the rate of temperature change of the content of the cooking vessel. Once the set temperature is reached, the controller 204 controls the power supplied to the induction coil 210 in an attempt to maintain the set temperature.

Cooking sequences include, for example, two or more sequenced combinations of a set temperature, maximum power setting, and/or cooking time (i.e. the duration of one or more cooking stages). The set temperature may be any temperature achievable by the cooktop.

Figure 3A:
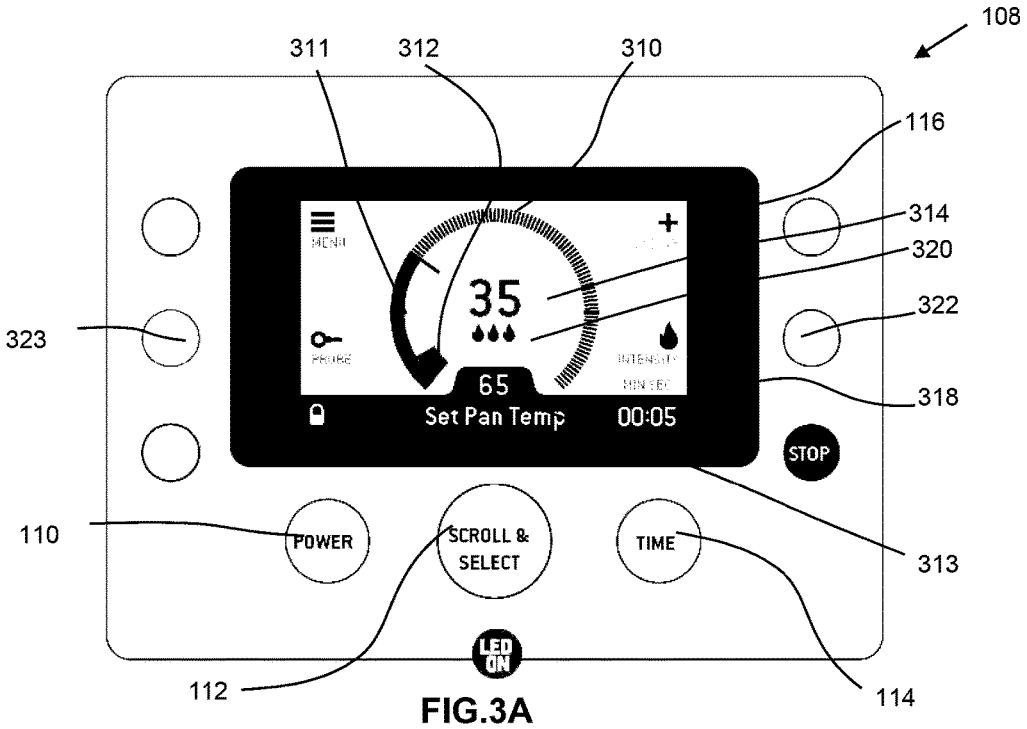
FIGS. 3A to 3D show different views of a user interface of the induction cooker of FIG. 1 during operation of the cooker.

FIG. 3A shows a view of the user interface 108 in more detail during operation of the cooker 100. The cooker 100 is switched on and off using the on/off power button 110. The cooking temperature is set with the central dial 112, whereas the cooking time is set with dial 114. The set cooking time is displayed in the bottom right corner 318 of the display 116.

In the display 116 temperatures are displayed graphically on a horseshoe shaped dial 310. More particularly, the set temperature is shown on the outside 311 of the dial 310, whereas measured temperature is shown on the inside 312 of the dial 310, preferably in a different colour. Additionally, the set temperature is shown textually at the bottom 313 of the display 116, whereas the measured temperature is shown in the centre 314 of the dial 310.

Flame icons 320 are displayed below the textual measured temperature 314, with the number of flame icons 320 being indicative of the maximum power setting. In the preferred implementation the maximum power setting has three levels indicated by one to three flame icons 320 respectively. The maximum power setting is changed by toggling push button 322.

Referring also to FIG. 2, the controller 204 uses the measured temperature as feedback to achieve the set temperature. Once the set temperature is reached, dependent upon settings of the cooker, the set temperature is maintained. Alternatively, once the set temperature is reached, the induction coils 210 may be deactivated, thereby terminating further heating of the cooking vessel, or controlled to reach and/or maintain a subsequent set temperature as programmed, e.g. a reduced temperature for a "keep warm" stage.

The measured temperature used by the controller 204 may be derived from surface temperature sensor 206 extending through the cooktop surface 104 and measuring the temperature of the bottom surface of the cooking vessel, or from the temperature probe 120, when connected, measuring the temperature of the food substance in the cooking vessel. Selection of the temperature probe 120 as source for the measured temperature to be used in the temperature control is achieved by depressing push button 323.

Figure 3B:
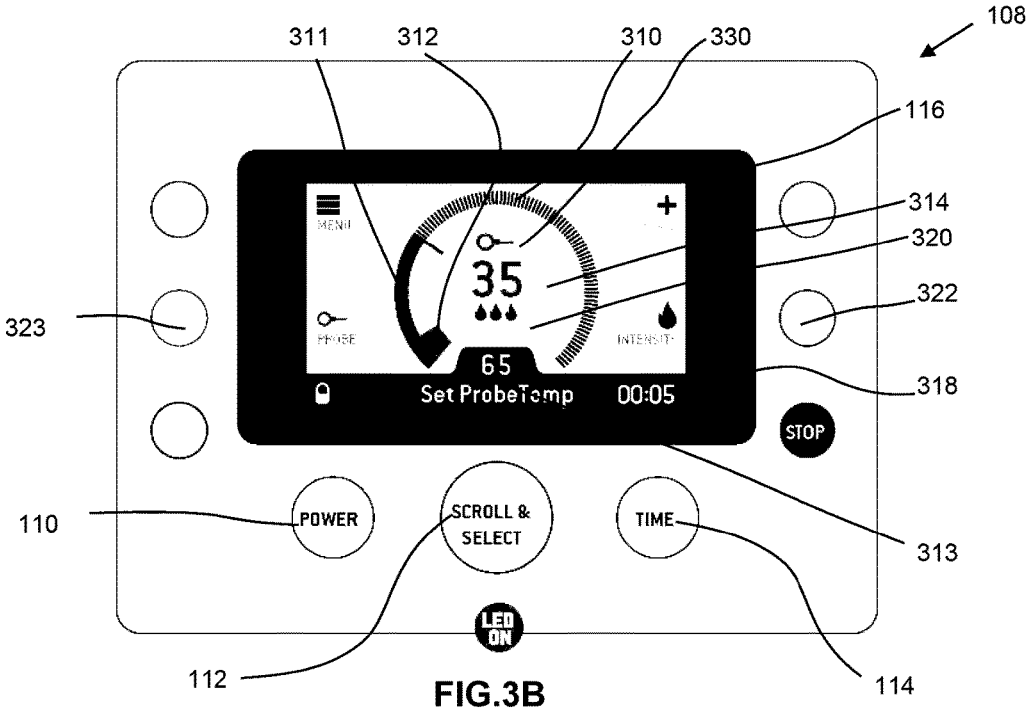

FIG. 3B shows another view of the user interface 108 in which the source for the measured temperature to be used for temperature control by the controller 204 is indicated to be the temperature probe 120, indicated by the display of a probe icon 330. In the event that the controller 204 determines that the temperature probe 120 is not connected, the measured temperature used by the controller 204 reverts to the measured temperature from the surface temperature sensor 206. Accordingly, the probe icon 330 is not displayed, as in the display 116 shown in FIG. 3A.

Because a user may typically remove the temperature probe 120 from the cooking vessel or contents often during the course of cooking, the controller 204 also determines whether the temperature measured by the temperature probe 120 is indicative of a likely temperature of the food substance in the cooking vessel. For example, when there is a large divergence between the temperatures derived from the surface temperature sensor 206 and the temperature probe 120 respectively, the controller 204 determines whether the temperature measured by the temperature probe 120 is unlikely. Alternatively, the controller 204 may determine whether the temperature measured by the probe 120 is within a range of the set temperature, for example between 10 to 30% less than the set temperature and 10 to 30% more than the set temperature, with the temperature being determined to be unlikely if outside that range. In the event that the temperature measured by the temperature probe 120 is determined to be unlikely, the measured temperature used by the controller 204 also reverts to the measured temperature from the surface temperature sensor 206.

Figure 3C:
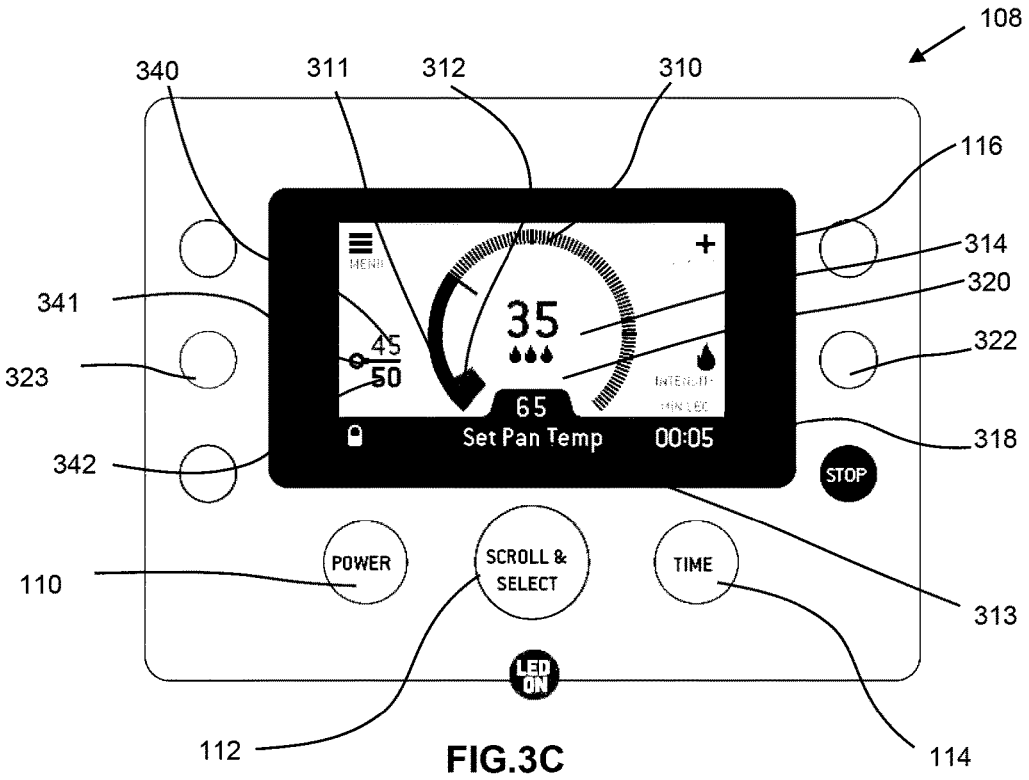

The temperature probe 120 may also be used to measure the temperature of ingredients in the cooking vessel, without that temperature being used by the controller 204 for temperature control. Accordingly, when the temperature probe 120 is connected, but temperature control using the probe 120 is not selected using button 323, the controller 204 uses the measured temperature from the surface temperature sensor 206 for temperature control. In that case, and as is shown in the view of the user interface 108 shown in FIG. 3C, the temperature measured by the temperature probe 120 is also displayed 340 above a probe icon 341.

A probe temperature alarm may also be set. In the event that a probe temperature alarm is set, the alarm temperature is displayed 342 below the probe icon 341. An alarm is activated upon the temperature measured by the temperature probe 120 reaching the alarm temperature. Alternatively or additionally, one or more other user-selectable options may be activated once the alarm temperature is reached. These include, and are not limited to:

- heating being terminated by the controller 204 by deactivating the induction coil 210, or
- the controller 204 controlling the power supplied to the induction coil 210 in order to maintain the alarm temperature.

Having described the cooker 100 and the user interface 108 of the cooker 100 in detail, cooking profiles are next described. As is described above, the maximum power setting may be changed by the user by depressing push button 322. However, the controller 204 may also apply different maximum power settings automatically based upon different set temperatures according to cooking styles typically associated with those temperatures.

Figure 4:
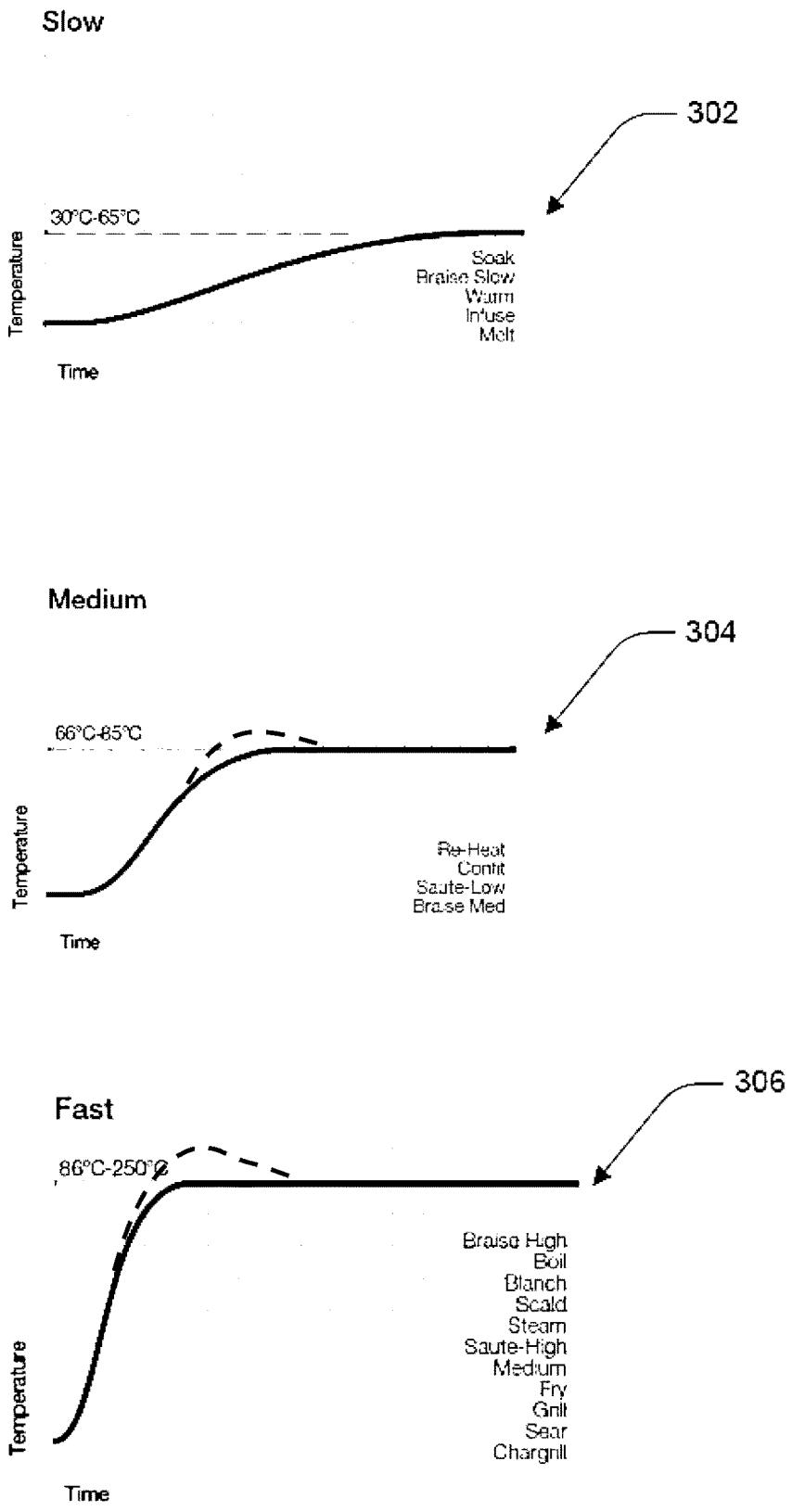
FIG. 4 shows different heating profiles having different rates of increase in temperature.

As can be seen in FIG. 4, for cooking styles utilising low temperatures (e.g. 30-65 degrees Celsius), a low maximum power setting is selected by the controller 204, resulting in heating profile 302 having a slow increase in temperature (e.g. over 5-8 minutes). The set temperature is reached slowly to avoid temperature overshoot, so that sensitive foods (e.g. eggs or milk) do not overheat or burn during the heating process. The low maximum power setting is preferably a ¼ to a ⅓ of the maximum appliance power.

Cooking styles utilising medium temperatures (e.g. 66-85 degrees Celsius) result in a medium maximum power setting being selected, causing a medium rate of temperature change (e.g. 3-4 minutes) as illustrated by heating profile 304. The set temperature is reached at a medium speed, typically resulting in a moderate temperature overshoot (shown in dotted lines). The medium maximum power setting is preferably ½ to ⅔ of the maximum power.

Cooking styles utilising high temperatures (e.g. 86-250 degrees Celsius) result in a high maximum power setting being selected by the controller 204, causing a faster rate of temperature change (e.g. 1-2 minutes) as illustrated by heating profile 306. The set temperature is reached at a highest speed, typically resulting in a large temperature overshoot (shown in dotted lines). The type of food that is prepared at such a high temperature (e.g. food being fried or sautéed) can often withstand this kind of temperature overshoot, and the advantage of a pan heated quickly is attained through use of the fast rate of temperature change. The high maximum power setting is preferably ¾ of the maximum power to maximum power.

Figure 5:
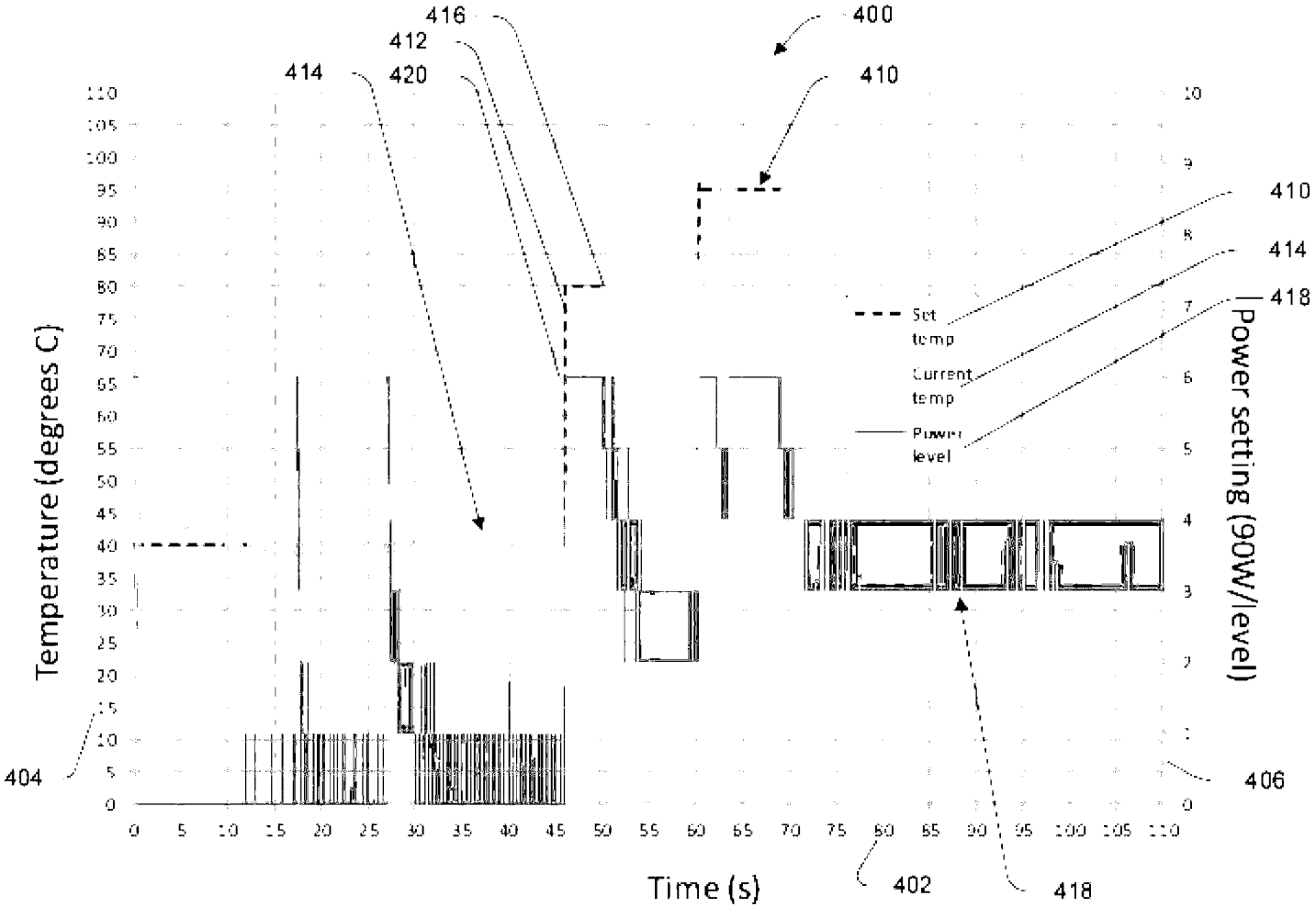
FIG. 5 shows a heating graph illustrating changes in temperature and the power applied to a heating system of the cooker shown in FIG. 1.

The heating process may be understood with reference to FIG. 5 which shows a heating graph 400 with time in seconds on the X-axis 402, temperature in degrees Celsius on the left Y-axis 404 and the power applied to the heating system in power levels on the right Y-axis 406. The set temperature 410 is shown in dotted lines, the measured temperature 414 is shown in a lighter grey, and the applied power level 418 is shown in a solid dark line.

The right Y-axis 406 shows power levels from 1 to 10. In this graph each power level represents approximately 90 Watt, and although only 10 levels are shown, the maximum power that can be supplied by the cooker represented in this graph is 20 levels (or 1800 Watt as used in the US). For simplicity, 20 substantially linear levels have been selected. However it will be understood that a different number of levels associated with different power settings may be selected, for example in a 2400 Watt cooker (as used in Australia), 15 levels each representing 160 Watt may be used. Alternatively, for a nonlinear allocation of power levers, the 15 levels may be associated with increasing power intervals, for example level 1 may be 80 Watt while level 15 may be 250 Watt.

In the heating graph 400 where the set temperature 410 increases, for example at point 412 (at approximately 47 seconds), the measured temperature 414 increases with negligible overshoot at point 416 (at approximately 50 seconds). The applied power 418 increases to level 6 (approximately 540 Watt) at point 420 after which the power decreases to avoid temperature overshoot. The applied power 418 decreases to level 3 where it remains in order to maintain the set temperature until approximately 60 seconds, when the set temperature is changed.

Figure 3D:
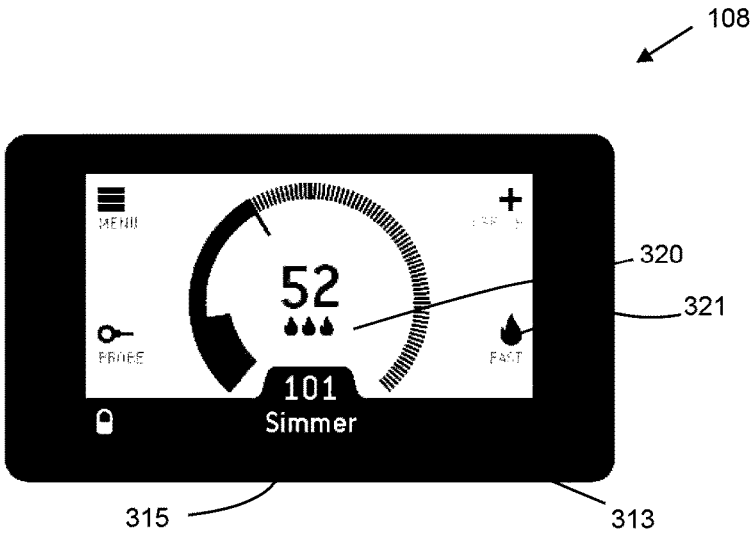

FIG. 3D shows a view of the display 116 during operation of the cooker 100. In order to assist users to gain an understanding of cooking with precise temperature and adjustable intensity, additional information is presented on the display 106. In addition to indicating the maximum power setting by displaying flame icons 320, a descriptor 321 indicative of the maximum power setting is also displayed. In the display shown in FIG. 3D the descriptor 321 is "Fast", indicating that the rate of temperate change is set to be fast. Different descriptors 321 are associated with different power settings. Also, in addition to indicating the set temperature, which is 101 degrees Celsius in the display shown in FIG. 3D, a descriptor 315 indicative of the set temperature is also displayed. Different descriptors 315 are associated with different temperature ranges. In the display shown in FIG. 3D the descriptor 315 is "Simmer". As the user turns the set temperature dial 112, the set temperature 313 shown changes, and the associated descriptor 315 also changes.

As described above the cooker 100 may operate using one-step heating or temperature profiles where a set temperature is selected and a default or user selected maximum power setting is selected. Multi-step temperature profiles may also be used. These include:

- simple cooking profiles (which include one or two set temperatures with a default or set maximum power setting, and optional time duration settings); and
- complex cooking sequences (which include one or more stages with associated set temperatures, maximum power setting and time duration settings).

Cooking profiles may be pre-programmed on the cooker 100 allowing the user to make a single selection to activate a sequence of temperature profiles. The user may alter these in real-time during the cooking process. In other embodiments the user selects a pre-programmed cooking sequence, or the user predefines a cooking sequence and then activates the sequence when cooking is commenced. Again, the user may modify the cooking sequence in real-time during the cooking process. In yet further embodiments the user may set a cooking sequence during the cooking process. Where cooking sequences are modified, these modifications may be saved on the cooker, either by default or according to user selection.

The user can also create and save cooking profiles or cooking sequences. The user settings input and saved to build the profiles and/or sequences are temperature-power combinations optionally accompanied by a time duration parameter. The created profiles/sequences may also include a post-cooking option as a final stage when the profile/sequence has been completed. The post-cooking option may be, for example, to deactivate the induction coil 210, or to control the induction coil 210 so that a "keep warm" temperature is maintained.

In one embodiment the cooking profiles use temperature measurements and set temperatures for known foods. For example, for water a "simmer" profile may be as simple as a temperature setting between 95 and 105 degrees Celsius. Similarly, a "boil then simmer" profile for water may be achieved by applying the maximum power until the measured temperature reaches 100-110 degrees Celsius, after which the set temperature is changed to between 95 and 100 degrees.

However, because different types of food behave differently, and because different temperatures are required at different atmospheric pressure (e.g. at different altitudes), another embodiment provides cooking profiles that utilise the rate of temperature change as determined from the temperature measurements. A transition from one cooking stage to the next stage is based on a measured rate of temperature change (of the pot or the food).

For example, for a "simmer" profile the rate of temperature change can be determined from the temperature measurements (e.g. over time intervals of 5-10 seconds, for example over time intervals of 6 seconds per interval). Once the rate of temperature change falls below a rate threshold (for example below ½ degree per second, 1 degree per second or 2 degrees per second), this is an indication that boiling point is being approached and the simmer set temperature selected accordingly.

Similarly, for a "boil then simmer" profile, if the measured temperature remains steady for a certain period of time, referred to herein as the "boiling threshold time" (e.g. 5 seconds, 10 seconds, 30 seconds or 60 seconds etc.), then the controller 204 determines that the boiling point has been reached. The set temperature for the subsequent simmer stage can then be set to a temperature below the measured boiling temperature, for example the simmer temperature may be selected to be between 1 and 10% less than the measured boiling temperature.

In other embodiments, the user is able to "calibrate" the cooker themselves, by defining a "boiling" point, a "simmer" range, etc. for the saved cooker profiles.

In some embodiments the user selects a pre-programmed cooking sequence, or the user predefines a cooking sequence and then activates the sequence when cooking is commenced. The user may alter the cooking sequence in real-time during the cooking process.

Figure 6:
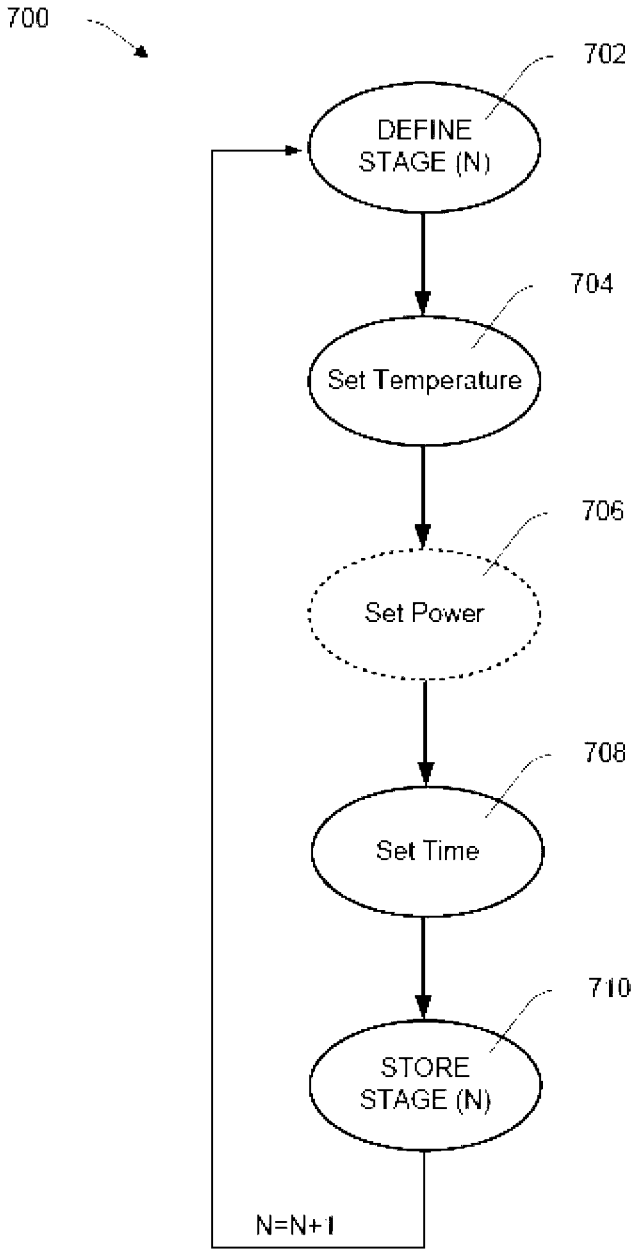
FIG. 6 shows a flow diagram of a method by which a user predefines a cooking sequence.

As an example, FIG. 6 shows a flow diagram 700 of a method by which a user predefines a cooking sequence. At step 702 the relevant stage (e.g. the initial stage, or a subsequent stage) of the cooking sequence is commenced and defined as such. At step 704 the required temperature is set. At optional step 706 the required maximum power is set. If the maximum power is not set then the default maximum power setting is used (as described in more detail elsewhere herein).

At step 708 the user selects a duration that the set temperature is to be maintained. In some embodiments this duration time setting is interpreted to define a time period that starts as soon as heating starts. In other embodiments the time period starts when the set temperature is reached. In other embodiments the time period starts when a threshold temperature is reached (where the threshold temperature is between the initial and the set temperature). In other embodiments the time period starts when the user prompts the time to start, for example after pasta is added after water in the cooking vessel reached boiling point. In other embodiments the time period starts when a previous stage or cooking option ends. Cooking options include:

"stop": the controller 204 terminates the heating process by deactivating the induction coil 210;

"keep warm": the controller 204 controls the induction coil 210 so that a "keep warm" cooking vessel temperature is maintained, e.g. 60-80 degrees;

"bit more": the same temperature at the same power is maintained for a period of time that is either pre-set (e.g. 1 minute), or determined, e.g. as a percentage of the elapsed cooking time, e.g. 5%, or to achieve a further increase in temperature, e.g. 2-5 degrees Celsius; or "REPEAT": the same temperature, power, and cooking duration is repeated, for example when cooking meat and the 2nd side has to be cooked.

At step 710 the settings for the relevant stage are stored, and the process is repeated as required.

Figure 7:
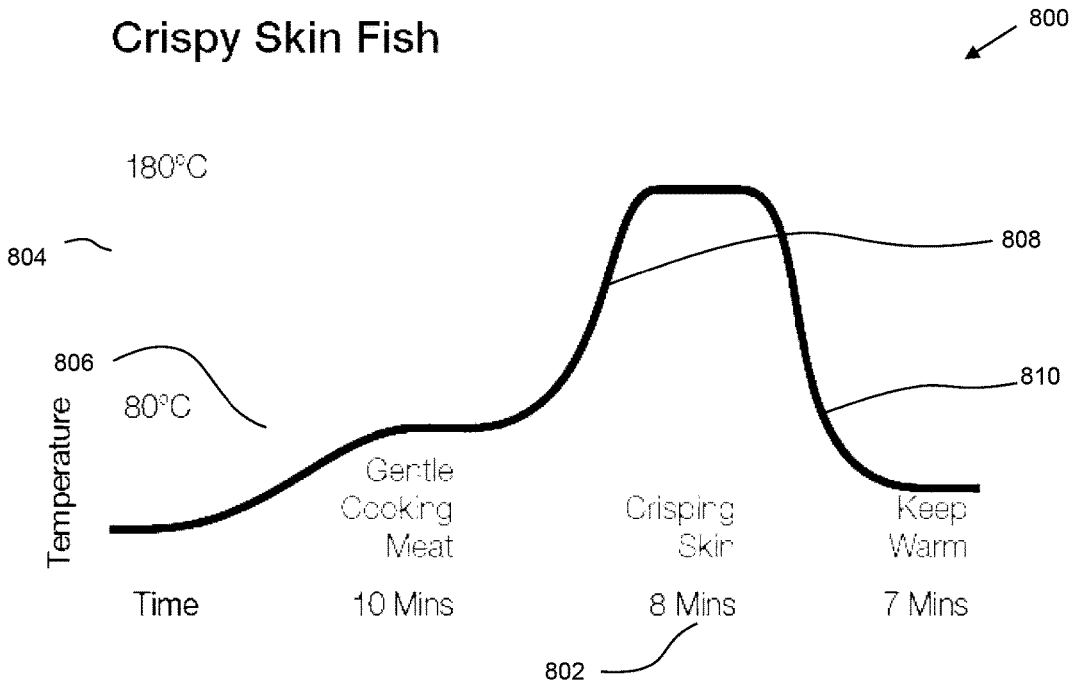
FIG. 7 shows a graph of an example cooking sequence for preparing crispy skin fish.

By following this process a cooking sequence, an example of which is shown in FIG. 7, can be set up. FIG. 7 shows a graph of an example cooking sequence 800 for preparing crispy skin fish, with time in minutes on the X-axis 802 and temperature in degrees Celsius on the Y-axis 804.

When cooking fish, the delicate proteins in the fish meat require a low temperature but the skin requires a high temperature to develop more flavour and create a crispy texture. To achieve this, the fish is initially cooked slowly at a low temperature, and the temperature is then increased very quickly to crisp the skin. This method avoids overcooking of the outer portion of the fish protein and undercooking the inside, while still achieving a crispy finish on the skin.

For this technique, high user intervention is typically required to cook at a low temperature to start with, and then, over time, to increase the temperature to crisp the skin. However, where a cooking sequence is predefined by the user (or even pre-programmed on the cooker), the process can be simplified for the user.

Three heating profiles make up the cooking sequence 800. The first heating profile 806 is shown between 0 and 10 minutes, and is a long, slow heating process to gently cook the meat. The second heating profile 808 is shown between 10 and 18 minutes, and includes a fast increase in temperature to a high temperature (180 degrees, as shown here), and this high temperature is used to crisp the skin quickly. The third heating profile 810 is shown between 18 and 25 minutes, and is an optional "keep warm" step in this process, that keeps the cooked fish warm for 7 minutes before serving. To accommodate variability (such as type of fish, weight and/or thickness, and/or initial food temperature) the user can modify the temperature, rate of temperature change and/or stage duration during the cooking process.

The foregoing describes only some embodiments of the present invention, and modifications and/or changes can be made thereto without departing from the scope and spirit of the invention, the embodiments being illustrative and not restrictive.

The invention claimed is:

1. An induction cooker comprising:

an induction element for heating a cooking vessel containing a food substance;

a first temperature sensor for measuring a temperature of the food substance;

a second temperature sensor for measuring a temperature of the cooking vessel;

a controller for:

determining whether the temperature from the first temperature sensor meets predefined criteria;

upon determining that the predefined criteria are met, controlling the induction element using only the temperature from the first temperature sensor to achieve a set temperature; and upon determining that the predefined criteria are not met, controlling the induction element using only the temperature from the second temperature sensor to achieve the set temperature.

2. The induction cooker according to claim 1 wherein the predefined criteria include the temperature from the first temperature sensor being within a predefined range from the set temperature.

3. The induction cooker according to claim 1 wherein the predefined criteria include a difference between the temperatures from the first and second temperature sensors exceeding a predefined threshold.

4. The induction cooker according to claim 1 wherein the controller further receives an input defining an action to be performed when the set temperature is reached, and wherein the controller controls the cooker to perform the action upon the set temperature being reached.

5. The induction cooker according to claim 4 wherein the action is selected from a group consisting of one or more of:

turning the induction element off;

changing the set temperature;

maintaining the set temperature; and maintaining the set temperature for a defined time period.

6. The induction cooker according to claim 1 wherein the controller further controls the induction element for a set period, the set period commences based on one of:

a user start prompt;

when heating commences; and when the set temperature is reached.

7. The induction cooker according to claim 1 further comprising:

a memory having stored therein a cooking sequence, the cooking sequence comprising a plurality of sequential stages, each stage being defined by a set temperature to be reached, a set maximum power applied to the induction element during heating and a time associated with the stage, wherein the controller further retrieves the cooking sequence and controls the induction element based upon the cooking sequence and the temperature measured.

8. The induction cooker according to claim 7 wherein at least one stage is further defined by a setting indicative of when the time associated with the stage is to commence.

9. The induction cooker according to claim 7 wherein the time associated with the stage commences based on one of:

a user start prompt;

when heating commences; and when the set temperature is reached.

10. The induction cooker according to claim 7 wherein at least one stage is further defined by a setting indicative that a next stage has a set temperature and set maximum power the same as the stage preceding the next stage.

* * * * *